US011859858B1

(12) United States Patent
Zarling

(10) Patent No.: US 11,859,858 B1
(45) Date of Patent: Jan. 2, 2024

(54) COPPER COATED AC DRAIN PAN BASIN

(71) Applicant: Terry Zarling, Miami, FL (US)

(72) Inventor: Terry Zarling, Miami, FL (US)

( * ) Notice: Subject to any disclaimer, the term of this patent is extended or adjusted under 35 U.S.C. 154(b) by 187 days.

(21) Appl. No.: 17/591,410

(22) Filed: Feb. 2, 2022

(51) Int. Cl.
*F24F 13/22* (2006.01)

(52) U.S. Cl.
CPC ..... *F24F 13/222* (2013.01); *F24F 2013/227* (2013.01)

(58) Field of Classification Search
CPC ..... F24F 2013/228; F24F 13/222
See application file for complete search history.

(56) References Cited

U.S. PATENT DOCUMENTS

| | | | | |
|---|---|---|---|---|
| 3,390,855 A | | 7/1968 | Solin | |
| 5,014,774 A | | 5/1991 | Siak et al. | |
| 5,017,284 A | | 5/1991 | Miler et al. | |
| 5,094,743 A | | 3/1992 | Miller et al. | |
| 5,264,250 A | * | 11/1993 | Steele | C09D 5/14 427/379 |
| 5,366,004 A | | 11/1994 | Garner et al. | |
| 6,041,611 A | | 3/2000 | Palmer | |
| 6,638,431 B2 | | 10/2003 | Back et al. | |
| 7,389,651 B2 | * | 6/2008 | Cantolino | C02F 1/688 62/288 |
| 7,392,821 B2 | | 7/2008 | Nakata et al. | |
| 8,104,502 B2 | | 1/2012 | Nakata et al. | |
| 8,561,417 B1 | | 10/2013 | Cantolino | |
| 9,016,221 B2 | * | 4/2015 | Brennan | A61L 2/02 428/141 |
| 9,352,986 B2 | | 5/2016 | Reinolds | |
| 10,816,255 B2 | | 10/2020 | Kim et al. | |
| 11,766,822 B2 | * | 9/2023 | Connell | B08B 17/065 428/156 |
| 2008/0053134 A1 | | 3/2008 | Akihiko et al. | |

FOREIGN PATENT DOCUMENTS

| | | | |
|---|---|---|---|
| EP | 2085711 | A2 | 8/2009 |
| JP | 2002284611 | A | 10/2002 |
| WO | 2020167653 | A1 | 8/2020 |

* cited by examiner

*Primary Examiner* — Filip Zec
(74) *Attorney, Agent, or Firm* — Albert Bordas, P.A.

(57) ABSTRACT

A copper coated AC drain pan basin, which has a drain pan assembly having a first layer of an adhesive substance and a second layer of copper. The drain pan assembly has a pan base, first and second longitudinal walls, first and second transversal walls, and an outlet. The pan base has a base top face. The adhesive substance is spread homogeneously onto the base top face. The copper is spread homogeneously onto the adhesive substance. The copper inhibits a growth of microorganisms in a water collected by the drain pan assembly.

9 Claims, 2 Drawing Sheets

COPPER COATED AC DRAIN PAN BASIN

BACKGROUND OF THE INVENTION

1. Field of the Invention

The present invention relates to drain pans, and more particularly, to heating, ventilation, and air conditioning drain pans having a layer of copper that inhibits a growth of microorganisms.

2. Description of the Related Art

Applicant believes that one of the closest references corresponds to U.S. Pat. No. 8,104,502 B2 issued to Nakata, et al. on Jan. 31, 2012 for Drain water bacteriostatic structure for air conditioner. However, it differs from the present invention because Nakata, et al. teach a drain water bacteriostatic structure for an air conditioner with a drain pan for holding drain water generated in an air conditioner and an upright antibacterial member, which is provided in the drain pan. The antibacterial member is provided with an antibacterial agent. The length of the antibacterial member in the up-down direction is set such that the lower end portion of the antibacterial member is immersed in drain water when the drain water is at the minimum water level in the drain pan, and the upper end portion of the antibacterial member is exposed above the maximum water level of drain water in the drain pan by a predetermined length or more.

Applicant believes that another reference corresponds to U.S. Pat. No. 6,638,431 B2 issued to Back, et al. on Oct. 28, 2003 for Formulation and method for treating wetted surface elements in climate control systems. However, it differs from the present invention because Back, et al. teach a formulation and method to treat and control microbial growth present in the water of climate control systems such as air conditioner air handlers, dehumidifiers, and humidifiers, which formulation can be entrained and dispersed into to living space air. Specifically, a formulation is provided in the form of a tablet or a spray for being applied onto a wetted surface element present in these systems, which will effectively control the growth of microbes such as fungus, molds, bacteria, and virus present on the surface for an extended period of time. The formulations include at least two metals, at least two chelating agents, at least one surfactant, and at least one viscosity enhancing compound.

Applicant believes that another reference corresponds to U.S. Pat. No. 5,366,004 A issued to Garner, et al. on Nov. 22, 1994 for Biostatic/biocidal coatings for air conditioner cores. However, it differs from the present invention because Garner, et al. teach an exterior surface of an evaporator, which carries a coating of dried paint resistant to microbial growth and suitable for forming an adhered layer on cooling surfaces of an air conditioner. This paint comprises a pigment, a liquid, a binder to promote formation and adherence of the coating after the paint is applied and dried, and a metallic constituent, which inhibits microbial growth. Preferably, the metallic constituent is inorganic and includes one or more of: copper, cupric carbonate, cuptic hydroxide, cuptic oxide, cuprous oxide, silver, silver oxide, zinc oxide, and zinc peroxide. The coating is preferably applied to the integral core after assembling and brazing the several plates and fins of the core.

Applicant believes that another reference corresponds to U.S. Pat. No. 8,561,417 B1 issued to Cantolino on Oct. 22, 2013 for Fluid-sensing switch system with redundant safety alarm capability. However, it differs from the present invention because Cantolino teaches a fluid-sensing switch system that can monitor pre-established threshold fluid levels in the primary drain pan inside an air conditioning unit or other condensate-producing unit, and also in a secondary drain pan positioned under the unit. Once the threaded plug of a sensing probe is connected to the unit's weep hole, it positions a center sensor providing a first power potential through a false-trigger-reducing resilient piece in a position to wait for rising fluid capable of breaching a weep hole dam. A substantially circular sensor is also present provides the second power potential needed for signal generation. A signal-generating member connected to both sensors is electrically connected to the unit to shut it off, and/or activate a pump that removes fluid from the secondary drain pan. The signal-generating member provides the redundant safety alarm capability, when mounted on a secondary drain pan.

Applicant believes that another reference corresponds to U.S. Pat. No. 5,094,743 A issued to Miller, et al. on Mar. 10, 1992 for Fluid purifying apparatus and method of purifying fluids. However, it differs from the present invention because Miller, et al. teach a liquid purification arrangement comprising a housing having an ambient inlet and lineally extending exhaust passage between the housing wall and a drain pan, the housing having a liquid inlet and outlet for a liquid system disposed within the housing which system includes a pump to move the liquid in the system, a blower, an orifice, looped liquid circuit and filtering arrangement, a moveable frame support, a disinfection/rejuvenation receptacle, an ultra-violet and distillation microbial reduction arrangement, a heating and cooling storage arrangement with a collapsible-expansible storage bag and switch arrangement therefor, and a check and alternating valve arrangement.

Applicant believes that another reference corresponds to U.S. Pat. No. 6,041,611 A issued to Palmer on Mar. 28, 2000 for System and method for cleaning air conditioning drains. However, it differs from the present invention because Palmer teaches a system for cleaning-out a condensate drain line. The condensate drain line is operatively associated with an air-conditioner that contains an evaporator coil and a primary drain pan. The system comprises a manifold operatively placed in fluid communication with the condensate drain line. The manifold includes a first, second, and third line. In one embodiment, the first line extends from the manifold, and the second and third line are axially aligned with the condensate drain line. The system further includes a first valve member disposed within the first line, a second valve member disposed within the second line, and a third valve member disposed within the third line. A water stream, which is operatively connected with the first line, is provided so that the water stream may be channeled through the manifold and into the condensate drain line. The manifold may further comprise a fourth line extending from the center of the manifold, with the fourth line having a fourth valve disposed therein. The system may further comprise sensor means, operatively associated with a secondary pan, for measuring the level of condensation within the secondary pan and activating an alarm once a predetermined level is reached. A method of cleaning a condensate drain line is also disclosed.

Applicant believes that another reference corresponds to U.S. Pat. No. 7,392,821 B2 issued to Nakata, et al. on Jul. 1, 2008 for Drain water discharge structure for air conditioner. However, it differs from the present invention because Nakata, et al. teach a drain water discharge structure for an air conditioning apparatus in which at least any one of an internal drain pipe and an external drain pipe is formed from an antibacterial metal pipe, thereby to inhibit the generation of slime in the external drain pipe and to make the external drain pipe less apt to deterioration.

Applicant believes that another reference corresponds to U.S. Pat. No. 5,014,774 A issued to Siak, et al. on May 14, 1991 for Biocidal coated air conditioning evaporator. However, it differs from the present invention because Siak, et al. teach an automotive air conditioning system evaporator core formed of an aluminum alloy and a biocidal coating comprising a zinc layer deposited onto said aluminum alloy and an outermost elemental copper plate overlying said zinc layer. During air cooling operations, slightly acidic condensate accumulating on the surface reacts with the copper to form cupric ions that inhibit microbial growth.

Applicant believes that another reference corresponds to U.S. Pat. No. 9,352,986 B2 issued to Reinolds on May 31, 2016 for Drain pan treatment apparatus utilizing recycled condensate water. However, it differs from the present invention because Reinolds teaches a drain pan treatment apparatus utilizing recycled condensate water to create a chemical solution that is delivered into the drain pan to prevent growth of algae and other microorganisms that may clog the drain port or drain conduit. The drain pan treatment apparatus comprises a diverter connector that directs a small amount of condensate water from the drain conduit or drain pump into a chemical canister containing a soluble solid chemical to create a chemical solution. The chemical solution is then delivered into the drain pan. If the air conditioner system does not include a drain pump, then a drain pump is added to deliver the condensate water to the chemical canister.

Applicant believes that another reference corresponds to U.S. Pat. No. 3,990,855 A issued to Cort, et al. on Nov. 9, 1976 for Clog preventing device for air conditioning condensate drain pans. However, it differs from the present invention because Cort, et al. teach a unit for prevention clogging in condensate drain pans by discharging an anti-bacterial chemical into the drain pan to prevent slime accumulation. The anti-bacterial chemical comprises of a first low-soluble anti-bacterial compound and a second readily soluble compound having a higher solubility that the first low soluble anti-bacterial compound. The device is provided with a novel cap having metering orifices for effecting a controlled diffusion rate of anti-bacterial chemicals into a drain pan and further including projections for spacing the metering orifices away from a surface, the spacing in combination with the metering orifices and solubility characteristic of the anti-bacterial chemical effecting a capillary action to introduce the anti-bacterial chemical through the orifice into contact with the condensate at a controlled rate. The cap is adapted to be secured to a container having anti-bacterial chemicals therein, the cap further including a water soluble sealant utilized to prevent the dry chemicals from being removed from the container during storge yet allowing condensate to be accumulated therein when the projections are disposed against a condensate accumulative surface.

Applicant believes that another reference corresponds to U.S. Pat. No. 10,816,225 B2 issued to Kim, et al. on Oct. 27, 2020 for Movable air conditioner. However, it differs from the present invention because Kim, et al. teach a movable air conditioner having a structure in which a drain pan is disposed above an outdoor heat exchange part disposed in a lower accommodation space, an indoor heat exchange part is disposed in an upper accommodation space above the drain pan, and a control box is mounted on the drain pan. A portion of the heat sink of the control box is exposed to the upper accommodation space, and another portion of the heat sink is exposed to the lower accommodation space.

Applicant believes that another reference corresponds to U.S. Pat. No. 5,017,284 A issued to Miler, et al. on May 21, 1991 for Fluid purifying apparatus and method of purifying fluids. However, it differs from the present invention because Miler, et al. teach a liquid purification arrangement comprising a housing having an ambient inlet and lineally extending exhaust passage between the housing wall and a drain pan, the housing having a liquid inlet and outlet for a liquid system disposed within the housing which system includes a pump to move the liquid in the system, a blower, an orifice, looped liquid circuit and filtering arrangement, a moveable frame support, a disinfection/rejuvenation receptacle, an ultra-violet and distillation microbial reduction arrangement, a heating and cooling storage arrangement with a collapsible-expansible storage bag and switch arrangement therefor, and a check and alternating valve arrangement.

Applicant believes that another reference corresponds to U.S. Patent Application Publication No. 2008/0053134 A1, published on Mar. 6, 2008 to Akihiko, et al. for Air Conditioner. However, it differs from the present invention because Akihiko, et al. teach a drain pan of an air conditioner with an antibacterial agent unit having an antibacterial agent capable of being brought into contact with drain water so that the antibacterial agent unit disposed in the vicinity of the suction port of the drain pump at the lowest portion in the drain pan is reliably immersed into the drain water when the drain pump is operating and not operating.

Applicant believes that another reference corresponds to EP Patent No. 2085711 A2 issued to Hayashi Yoshikazu on Aug. 5, 2009 for Air conditioner having antibacterial unit for drain water. However, it differs from the present invention because Hayashi Yoshikazu teaches an air conditioner having a heat exchanger, a drain pan for receiving drain water generated in the heat exchanger, a drain pump for pumping up drain water stocked in the drain pan and discharging the drain water to the outside of the air conditioner and an antibacterial agent unit having a recess portion located below a suction port of the drain pump, the antibacterial agent unit is provided with a mount portion around the recess portion, antibacterial agent being filled in the mount portion, a first opening portion through which drain water dropping from the suction port of the drain pump into the recess portion is introduced into the mount portion, and a second opening portion through which the drain water introduced into the mount portion is discharged to the outside of the antibacterial agent unit.

Applicant believes that another reference corresponds to JP Patent Application Publication No. 2002284611 A, published on Oct. 3, 2002 to Hirasawa Kiyoshi for Implement for preventing growth of microorganism and method for using the same. However, it differs from the present invention because Masakazu teaches an implement for preventing the growth of microorganisms within an air conditioner or the like, and to provide a method for preventing the growth of microorganisms using the implement. The implement for preventing the growth of microorganisms is obtained by immersing a copper plate in an aqueous solution of sodium pyrithion and drying the copper plate.

Applicant believes that another reference corresponds to WO Patent Application Publication No. 2020167653 A1, published on Aug. 20, 2020 to Consentino, Louis, Ciro for System for electro-chemically inhibiting biological growth in air treatment units. However, it differs from the present invention because Consentino teaches systems and methods for inhibiting growth of fungi and other organisms in air treatment systems such as air conditioners, humidifiers, dehumidifiers, and air washers. A pair of electrodes are brought into contact with liquid collected by a collection subsystem of the air treatment system. One of the electrodes includes a bio-inhibiting conductor. Electrical current is caused to pass between the electrodes, causing the bio-inhibiting conductor to be released into the collected liquid.

Other patents describing the closest subject matter provide for a number of more or less complicated features that fail to solve the problem in an efficient and economical way. None of these patents suggest the novel features of the present invention.

SUMMARY OF THE INVENTION

The present invention is a copper coated AC drain pan basin, comprising a drain pan assembly having a first layer of an adhesive substance and a second layer of copper.

The drain pan assembly comprises a pan base, first and second longitudinal walls, first and second transversal walls, and an outlet. The pan base comprises a base top face. The adhesive substance is spread homogeneously onto the base top face. The copper is spread homogeneously onto the adhesive substance.

The base top face defines a first predetermined area, and the first layer of the adhesive substance with the second layer of the copper defines a second predetermined area. The first predetermined area and the second predetermined area are approximately the same.

The adhesive substance may be an epoxy adhesive, a cyanoacrylate adhesive, a polyurethane adhesive, or a natural adhesive.

The adhesive substance is a liquid, a spray, or a paste. The adhesive substance is a spray glue. The copper is in powder, filaments, and/or flakes. The adhesive substance is infused with the copper.

The copper inhibits a growth of microorganisms in a water collected by the drain pan assembly. The microorganisms are fungus, molds, and/or bacteria.

The drain pan assembly is incorporated to an evaporator drain system of heating, ventilation, and air conditioning systems.

The water collected in the drain pan assembly is free of mold, bacteria, and fungus.

It is therefore one of the main objects of the present invention to provide a copper coated AC drain pan basin.

It is therefore one of the main objects of the present invention to provide a copper coated AC drain pan basin, which has a layer of glue and a layer of copper.

It is another object of this invention to provide a copper coated AC drain pan basin that prevents the growth of microorganisms in the water collected by the drain pan of the heating, ventilation, and air conditioning systems.

It is another object of this invention to provide a copper coated AC drain pan basin that can be readily assembled and disassembled without the need of any special tools.

It is another object of this invention to provide a copper coated AC drain pan basin, which is of a durable and reliable construction.

It is yet another object of this invention to provide such a copper coated AC drain pan basin that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
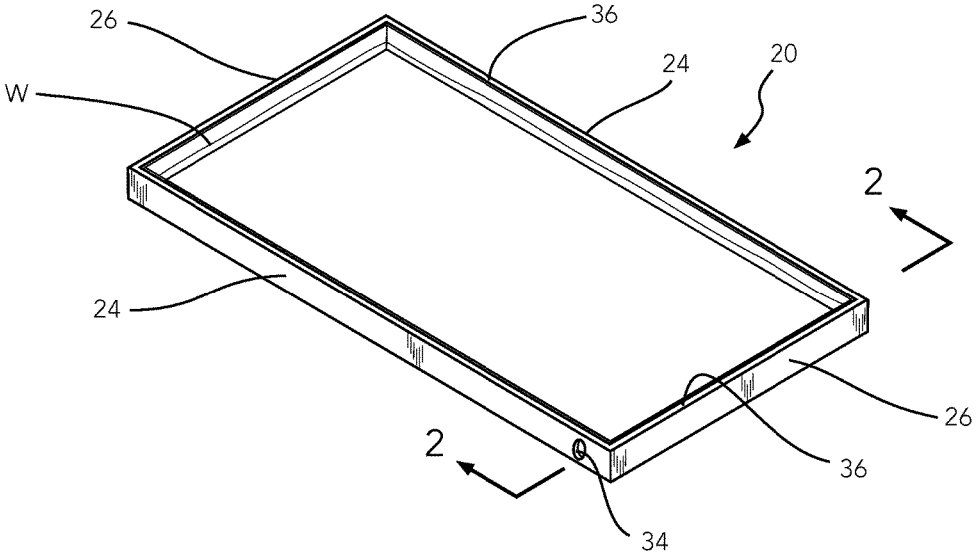
FIG. 1 is an isometric view of a drain pan assembly of the present invention.

Referring now to the drawings, the present invention is a copper coated AC drain pan basin and is generally referred to with numeral 10. It can be observed that it basically includes drain pan assembly 20.

Figure 2:
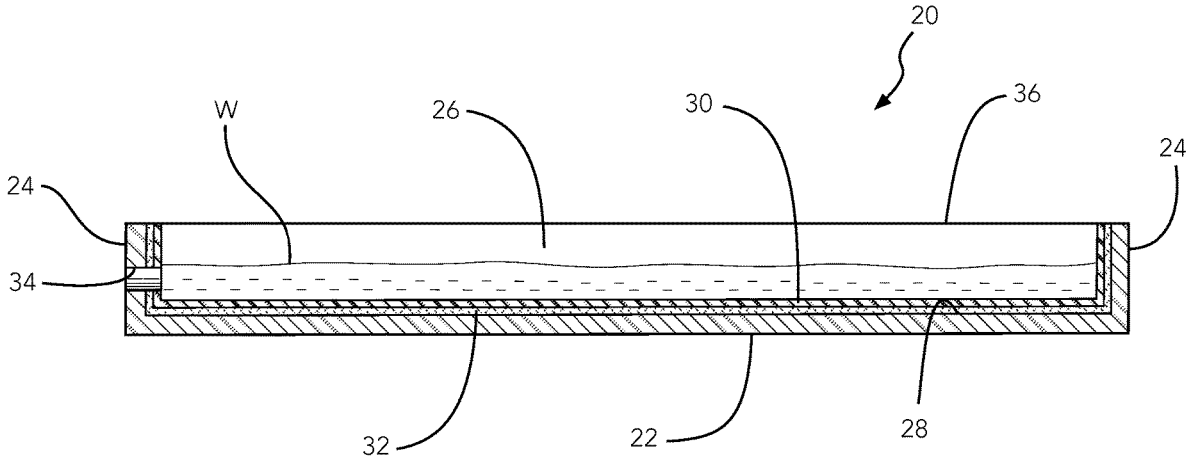
FIG. 2 is a cut view taken along lines 2-2 from FIG. 1.

As seen in FIGS. 1 and 2, drain pan assembly 20 comprises pan base 22, first and second longitudinal walls 24, first and second transversal walls 26, outlet 34, and top edge 36. Pan base 22 comprises base top face 28. Drain pan assembly 20 further comprises a first layer of adhesive substance 32, and a second layer of copper 30, wherein adhesive substance 32 is spread onto base top face 28, and copper 30 is spread onto adhesive substance 32. In a preferred embodiment, adhesive substance 32 is spread homogeneously onto base top face 28, and copper 30 is spread homogeneously onto adhesive substance 32. The first layer of adhesive substance 32 in one embodiment is applied first, against base top face 28, and then copper 30 is spread onto adhesive substance 32.

Base top face 28 defines a first predetermined area, and the first layer of adhesive substance 32 with the second layer of copper 30 defines a second predetermined area. The first predetermined area and the second predetermined area are approximately the same. Adhesive substance 32 may be an epoxy adhesive, a cyanoacrylate adhesive, a polyurethane adhesive, a natural adhesive, or any other adhesive having similar characteristics. Adhesive substance 32 may be a liquid, spray, or paste substance. In a preferred embodiment, adhesive substance 32 is a spray glue. In a preferred embodiment, copper 30 is in powder, filament, and/or flake form. Adhesive substance 32 is infused with copper 30. Copper 30 inhibits a growth of microorganisms in water W collected by drain pan assembly 20. The microorganisms may be fungus, mold, and/or bacteria. In operation, water W, collected in drain pan assembly 20, is free of mold, bacteria, and fungus, whereby water W contacts copper 30 in a preferred embodiment. It is noted that water W is only shown for illustrative purposes in FIGS. 1 and 2. It is understood that water W only lands onto drain pan assembly 20 once incorporated within evaporator drain system 60 of an HVAC (heating, ventilation, and air conditioning) system as seen in FIG. 3.

Figure 3:
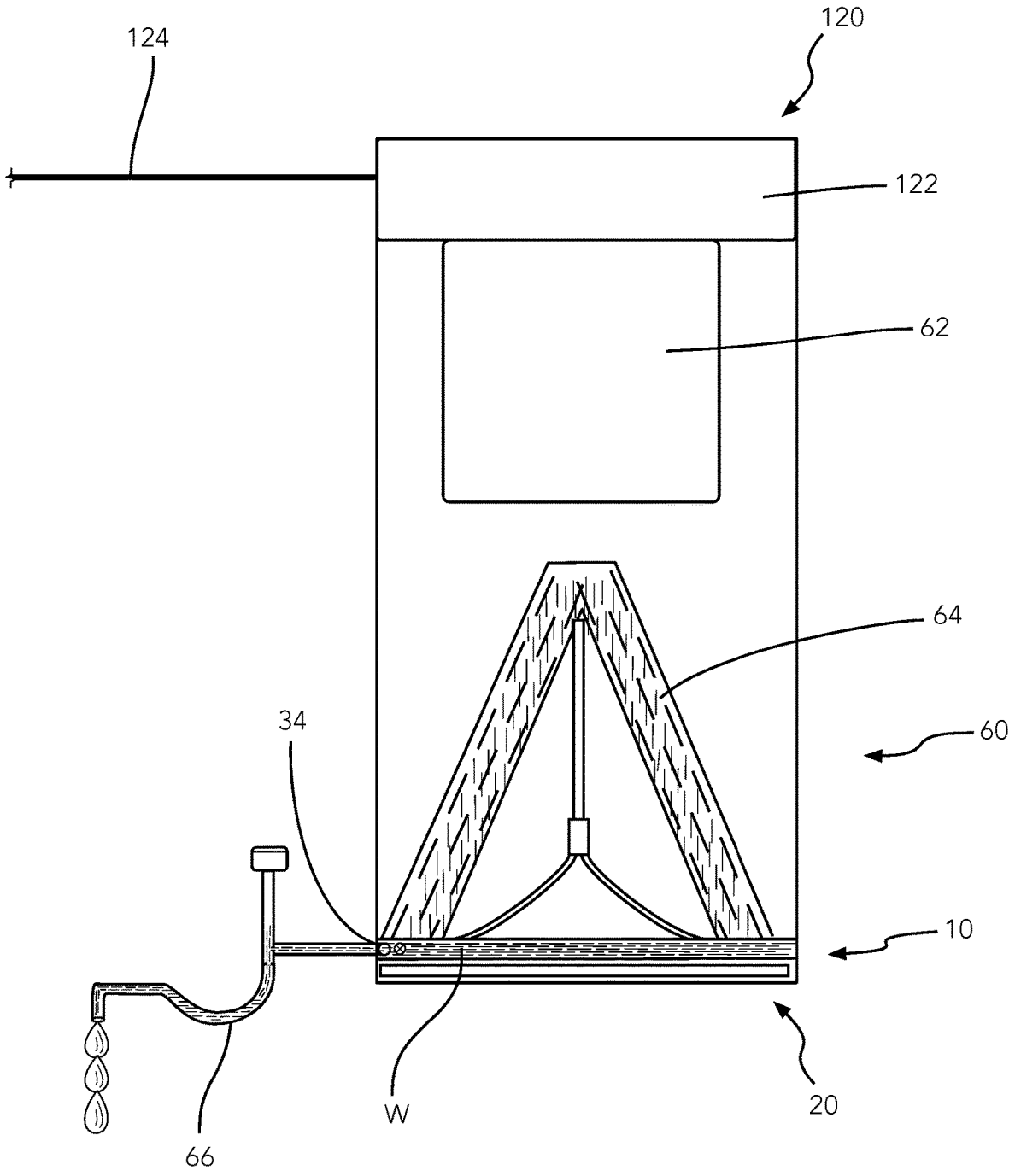
FIG. 3 is a view representing an evaporator drain system of an HVAC (heating, ventilation, and air conditioning) system.

As seen in FIG. 3, drain pan assembly 20 is incorporated within evaporator drain system 60 of an HVAC system. In a preferred embodiment, evaporator drain system 60 comprises blower fan 62, evaporator coils 64, and drainage line 66. Water W drains through outlet 34 to drainage line 66. Copper 30 prevents or eliminates growth of microorganisms, algae, gunk and/or other matter that otherwise would grow on drain pan assembly 20, allowing it to remain clean. Copper 30 also prevents or eliminates growth of microorganisms, algae, gunk and/or other matter that otherwise would clog drainage line 66, therefore allowing it to remain unclogged.

In a preferred embodiment, electrical system 120 comprises power unit 122 and electric connection 124. In a preferred embodiment, power unit 122 operates with 110 or 240 Volt.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A copper coated AC drain pan basin, comprising a drain pan assembly having a first layer of an adhesive substance and a second layer of copper, said drain pan assembly comprises a pan base having a base top face, first and second longitudinal walls, first and second transversal walls, and an outlet, said adhesive substance is spread homogeneously onto said base top face and said copper is spread homogeneously onto said adhesive substance, wherein said copper is in form of at least one of powder, filaments, or flakes, and said adhesive substance is infused with said copper, wherein said adhesive substance is selected from the group consisting of an epoxy adhesive, a cyanoacrylate adhesive, a polyurethane adhesive, and a natural adhesive.

2. The copper coated AC drain pan basin set forth in claim 1, wherein said base top face defines a first predetermined area, and said first layer of said adhesive substance with said second layer of said copper defines a second predetermined area.

3. The copper coated AC drain pan basin set forth in claim 1, wherein said first predetermined area and said second predetermined area are approximately same.

4. The copper coated AC drain pan basin set forth in claim 1, wherein said adhesive substance is a liquid, a spray, or a paste.

5. The copper coated AC drain pan basin set forth in claim 1, wherein said adhesive substance is a spray glue.

6. The copper coated AC drain pan basin set forth in claim 1, wherein said copper inhibits a growth of microorganisms in a water collected by said drain pan assembly.

7. The copper coated AC drain pan basin set forth in claim 6, wherein said microorganisms are fungus, mold, and/or bacteria.

8. The copper coated AC drain pan basin set forth in claim 1, wherein said drain pan assembly is incorporated to an evaporator drain system of a heating, ventilation, and air conditioning system.

9. The copper coated AC drain pan basin set forth in claim 6, wherein said water collected in said drain pan assembly is free of mold, bacteria, and fungus.

* * * * *